US006552705B1

(12) United States Patent
Hirota

(10) Patent No.: US 6,552,705 B1
(45) Date of Patent: Apr. 22, 2003

(54) METHOD OF DRIVING FLAT-PANEL DISPLAY DEVICE

(75) Inventor: Shinichi Hirota, Saitama-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/563,494

(22) Filed: May 3, 2000

(30) Foreign Application Priority Data

May 11, 1999 (JP) ..... 11-130391

(51) Int. Cl.[7] ..... G09G 3/36

(52) U.S. Cl. ..... 345/92; 345/103; 345/94; 345/205; 345/208

(58) Field of Search ..... 345/87–104, 204–205, 345/208–210, 58; 348/790, 792; 349/40, 41

(56) References Cited

U.S. PATENT DOCUMENTS

| | | | | | |
|---|---|---|---|---|---|
| 4,922,240 A | * | 5/1990 | Duwaer | 340/784 |
| 5,113,181 A | | 5/1992 | Inoue et al. | 340/784 |
| 5,241,304 A | * | 8/1993 | Munetsugu et al. | 340/784 |
| 5,654,735 A | | 8/1997 | Nakajima | 345/99 |
| 5,699,076 A | * | 12/1997 | Tomiyasu | 345/103 |
| 5,959,600 A | * | 9/1999 | Uchino et al. | 345/94 |
| 6,166,715 A | | 12/2000 | Chang et al. | 345/100 |
| 6,201,523 B1 | | 3/2001 | Akiyama et al. | 345/96 |
| 6,219,022 B1 | * | 4/2001 | Yamazaki et al. | 345/103 |
| 6,307,532 B1 | * | 10/2001 | Aoki | 345/94 |

FOREIGN PATENT DOCUMENTS

| | | | | |
|---|---|---|---|---|
| EP | 0 755 044 | | 1/1997 | |
| JP | 403220592 | * | 9/1991 | G09G/3/36 |
| JP | 10-97229 | | 4/1998 | |
| JP | 11-338441 | | 12/1999 | |

* cited by examiner

*Primary Examiner*—Lun-Yi Yao
(74) *Attorney, Agent, or Firm*—Oblon, Spivak, McClelland, Maier & Neustadt, P.C.

(57) ABSTRACT

A method of driving a flat-panel display device divides a frame into areas and makes the boundary of each area inconspicuous, to properly show images on the display. The method prepares compensation data whose voltages are substantially equal to those of video data provided at the start of a horizontal scan period and supplies the compensation data to video bus lines in a blanking period of the preceding horizontal scan period.

11 Claims, 10 Drawing Sheets

FIG.8

COMPENSATION DATA

VIDEO DATA

L1 (24 LINES)

| POL=0 | POL=1 |
|---|---|
| L1P1 | L1N1 |
| L1N1 | L1P1 |
| L1P2 | L1N2 |
| L1N2 | L1P2 |
| L1P3 | L1N3 |
| L1N3 | L1P3 |
| L1P4 | L1N4 |
| L1N4 | L1P4 |
| L1P5 | L1N5 |
| L1N5 | L1P5 |
| L1P6 | L1N6 |
| L1N6 | L1P6 |
| L1P7 | L1N7 |
| L1N7 | L1P7 |
| L1P8 | L1N8 |
| L1N8 | L1P8 |
| L1P9 | L1N9 |
| L1N9 | L1P9 |
| L1P10 | L1N10 |
| L1N10 | L1P10 |
| L1P11 | L1N11 |
| L1N11 | L1P11 |
| L1P12 | L1N12 |
| L1N12 | L1P12 |

| | BLOCK 1 | 2 | 3 | 4 | | 31 | 32 |
|---|---|---|---|---|---|---|---|
| R 249 | R 249 | R 241 | R 233 | R 225 | R 17 | R 9 | R 1 |
| G 249 | G 249 | G 241 | G 233 | G 225 | G 17 | G 9 | G 1 |
| B 249 | B 249 | B 241 | B 233 | B 225 | B 17 | B 9 | B 1 |
| R 250 | R 250 | R 242 | R 234 | R 226 | R 18 | R 10 | R 2 |
| G 250 | G 250 | G 242 | G 234 | G 226 | G 18 | G 10 | G 2 |
| B 250 | B 250 | B 242 | B 234 | B 226 | B 18 | B 10 | B 2 |
| R 251 | R 251 | R 243 | R 235 | R 227 | R 19 | R 11 | R 3 |
| G 251 | G 251 | G 243 | G 235 | G 227 | G 19 | G 11 | G 3 |
| B 251 | B 251 | B 243 | B 235 | B 227 | B 19 | B 11 | B 3 |
| R 252 | R 252 | R 244 | R 236 | R 228 | R 20 | R 12 | R 4 |
| G 252 | G 252 | G 244 | G 236 | G 228 | G 20 | G 12 | G 4 |
| B 252 | B 252 | B 244 | B 236 | B 228 | B 20 | B 12 | B 4 |
| R 253 | R 253 | R 245 | R 237 | R 229 | R 21 | R 13 | R 5 |
| G 253 | G 253 | G 245 | G 237 | G 229 | G 21 | G 13 | G 5 |
| B 253 | B 253 | B 245 | B 237 | B 229 | B 21 | B 13 | B 5 |
| R 254 | R 254 | R 246 | R 238 | R 230 | R 22 | R 14 | R 6 |
| G 254 | G 254 | G 246 | G 238 | G 230 | G 22 | G 14 | G 6 |
| B 254 | B 254 | B 246 | B 238 | B 230 | B 22 | B 14 | B 6 |
| R 255 | R 255 | R 247 | R 239 | R 231 | R 23 | R 15 | R 7 |
| G 255 | G 255 | G 247 | G 239 | G 231 | G 23 | G 15 | G 7 |
| B 255 | B 255 | B 247 | B 239 | B 231 | B 23 | B 15 | B 7 |
| R 256 | R 256 | R 248 | R 240 | R 232 | R 24 | R 16 | R 8 |
| G 256 | G 256 | G 248 | G 240 | G 232 | G 24 | G 16 | G 8 |
| B 256 | B 256 | B 248 | B 240 | B 232 | B 24 | B 16 | B 8 |

L2 (24 LINES)

| POL=0 | POL=1 |
|---|---|
| L1P1 | L1N1 |
| L1N1 | L1P1 |
| L1P2 | L1N2 |
| L1N2 | L1P2 |
| L1P3 | L1N3 |

| | BLOCK 1 | 2 | 3 | 4 | | 31 | 32 |
|---|---|---|---|---|---|---|---|
| R 257 | R 257 | R 265 | R 273 | R 281 | R | R 497 | R 505 |
| G 257 | G 257 | G 265 | G 273 | G 281 | G | G 497 | G 506 |
| B 257 | B 257 | B 265 | B 273 | B 281 | B | B 497 | B 506 |
| R 258 | R 258 | R 266 | R 274 | R 282 | R 2 | R 497 | R 507 |
| G 258 | G 258 | G 266 | G 274 | G 282 | G 2 | G 497 | G 507 |

R1 (24 LINES)

| POL=0 | POL=1 |
|---|---|
| R1P1 | R1N1 |
| R1N1 | R1P1 |
| R1P2 | R1N2 |
| R1N2 | R1P2 |
| R1P3 | R1N3 |

| | BLOCK 1 | 2 | 3 | 4 | 5 | | 32 |
|---|---|---|---|---|---|---|---|
| R 761 | R 761 | R 753 | R 745 | R 737 | R 729 | 521 | R 513 |
| G 761 | G 761 | G 753 | G 745 | G 737 | G 729 | 521 | G 513 |
| B 761 | B 761 | B 753 | B 745 | B 737 | B 729 | 521 | B 513 |
| R 762 | R 762 | R 754 | R 746 | R 738 | R 730 | 522 | R 514 |
| G 762 | G 762 | G 754 | G 746 | G 738 | G 730 | 522 | G 514 |

R2 (24 LINES)

| POL=0 | POL=1 |
|---|---|
| R1P1 | R1N1 |
| R1N1 | R1P1 |
| R1P2 | R1N2 |
| R1N2 | R1P2 |
| R1P3 | R1N3 |

| | BLOCK 1 | 2 | 3 | 4 | 5 | | 31 | 32 |
|---|---|---|---|---|---|---|---|---|
| R 769 | R 769 | R 777 | R 785 | R 793 | R | | R 1009 | R 1017 |
| G 769 | G 769 | G 777 | G 785 | G 793 | G | 1 | G 1009 | G 1017 |
| B 769 | B 769 | B 777 | B 785 | B 793 | B | 1 | B 1009 | B 1017 |
| R 770 | R 770 | R 778 | R 785 | R 794 | | 02 | R 1010 | R 1018 |
| G 770 | G 770 | G 778 | G 785 | G 794 | | 02 | G 1010 | G 1018 |

METHOD OF DRIVING FLAT-PANEL DISPLAY DEVICE

The present patent application claims the benefit of earlier Japanese Patent Application No. H11-130391 filed on May 11, 1999, the disclosure of which is incorporated herein by reference.

BACKGROUND OF THE INVENTION

1. Field of the Invention

The present invention relates to a method of driving a flat-panel display device such as a liquid crystal display device, and particularly, to a method of driving an active-matrix liquid crystal display device.

2. Description of the Related Art

Flat-panel display devices, in particular, liquid crystal display devices are light, thin, and low power consumption and are widely used. Among them, active-matrix liquid crystal display devices (AM-LCDs) employing switch elements for each pixel are popularly used in offices.

The switch elements used for AM-LCDs are mainly polysilicon TFTs. The AM-LCDs with polysilicon TFTs are capable of integrating drivers on a glass substrate of a liquid crystal panel, and therefore, are advantageous in simplifying wiring and reducing sizes.

In an AM-LCD with polysilicon TFTs, drivers integrated on a glass substrate of a liquid crystal (LC) panel are connected to an external driver through FPCs (flexible printed circuits). The external driver sends analog video data to the drivers on the LC panel. The analog video data is sampled through video bus lines and analog switches for data lines of the LC panel. The data lines hold video data, which is written into pixel electrodes of the LC panel through TFTs provided to the pixel portion.

The external driver sends analog video data to the driver on the LC panel at a speed of 40 MHz for SVGA (800×600 pixels), and 65 MHz for XGA (1024×768 pixels). These speeds are too fast for present polysilicon TFTs, and therefore, must be slowed down. To achieve this, one proposal divides a frame to be displayed on an LC panel into areas and simultaneously drive the areas. Another proposal divides a frame into areas, divides each of the areas into blocks each including "n" data lines, and simultaneously drives the areas while sequentially driving the blocks one after another in each. This proposal is capable of slowing down the operation speed of TFTs, than that proposal.

A method of driving an AM-LCD with polysilicon TFTs by dividing a frame into areas and each area into blocks will be explained. The example mentioned below divides each area into 32 blocks and sequentially drives the blocks from the block 1 toward the block 32.

FIG. 1 is a timing chart showing the operation of the AM-LCD whose frame is divided into areas and each area into 32 blocks.

An external driver (not shown) receives video data (c), prepares video data (d) for each block, and sends the video data (d) to a data line driver on the LCD.

The video data (d) corresponds to video data (b) for one block. The video data (c) is asynchronous to the video data (d).

The external driver receives the video data (c) that includes, for example, red data R249 to R256, green data G249 to G256, and blue data B249 to B256 in series from, for example, a personal computer (PC). The external driver rearranges these data pieces, prepares the parallel video data (d) such as R249, G249, and B249 to R256, G256, and B256, and supplies the video data (d) to the data line driver on the LCD. The details of the rearrangement of data pieces will be explained later.

The video data (d) is sent to, for example, the block 1. Each block collectively receives its own video data, and the blocks in each area sequentially receive video data to fill a horizontal line in each area.

A horizontal scan period is consists of a write period (W) and a blanking period (B). The video data (b) is supplied to video bus lines in a write period (W) of a horizontal synchronous signal (a) that determines each horizontal scan period. The video bus lines are connected to data lines contained in the blocks of each area. In FIG. 1, the blocks 1 to 32 sequentially receive video data through the video bus lines during a write period (W). After a blanking period (B), the blocks 1 to 32 again receive data one after another. In each blanking period (B), video data is supplied which irrelevant to display.

The data lines and video bus lines has capacitance and resistance elements whose sizes vary due to manufacturing variations. These elements cause a video data transmission delay, i.e., a voltage delay. The voltage delay increases as a time constant in wiring increases. A large voltage delay prevents video data sampled for a data line from acquiring a required voltage. A shift register in the driver on the LCD involves manufacturing variations, and these variations also cause insufficient voltages on some data lines. When the blocks in each area are sequentially scanned, a block that is proximate to the boundary of the area, i.e., a first block to be driven at the start of a write period frequently receives insufficient voltages for video data sampled for the first block. This results in deteriorating the contrast of the block and making the boundary of the area noticeable.

A large voltage delay also causes a double sampling of video data to show a so-called ghost. The ghost frequently occurs in the last block in each area at the end of a write period.

When a horizontal line displays halftones on consecutive pixels and black on a last pixel, the horizontal line partly becomes white. When a horizontal line displays halftones on consecutive pixels and white on a last pixel, the horizontal line partly becomes black. These problems occur due to horizontal crosstalk and deteriorate the quality of display.

SUMMARY OF THE INVENTION

An object of the present invention is to provide a method of driving a flat-panel display device that divides a frame into areas, capable of making boundaries among the areas unnoticeable and clearly displaying images on the display.

Another object of the present invention is to provide a method of driving a flat-panel display device, capable of preventing ghosts and displaying high-quality images on the display.

Still another object of the present invention is to provide a method of driving a flat-panel display device, capable of eliminating horizontal crosstalk and displaying high-quality images on the display.

In order to accomplish the objects, the present invention provides a method of driving a flat-panel display that consists of a first electrode substrate, a second electrode substrate, an optical modulation layer, a data line driver, a gate line driver, and an external driver. The first electrode substrate includes data lines, gate lines to form a matrix with the data lines, pixel electrodes formed at intersections of the data and gate lines, respectively, and switch elements provided for the pixel electrodes, respectively. Each of the switch elements is turned on and off by a gate signal passed through a corresponding one of the gate lines and connects, if turned on, a corresponding one of the data lines to the corresponding pixel electrode to write sampled video data on the data line into the pixel electrode. The second electrode substrate includes counter electrodes that face the pixel electrodes with a predetermined gap between them. The optical modulation layer is sandwiched between the first and second electrode substrates. The data line driver connects "n" of the data lines to video bus lines and samples video data for the n data lines in synchronization with a horizontal scan period. The gate line driver supplies a gate signal to one of the gate lines in synchronization with a horizontal scan period. The external driver converts external video data into video data for "n" of the data lines and collectively supplies the video data to the video bus lines. The method includes the steps of preparing, for each horizontal scan period, compensation data "A" whose voltages are substantially equal to those of video data to be supplied to the video bus lines at the start of a write period of the horizontal scan period in question, and supplying the compensation data "A" to the video bus lines during a blanking period of a horizontal scan period that just precedes the horizontal scan period in question.

This method prepares, for each horizontal scan period, compensation data "A" whose voltages are substantially equal to those of video data to be supplied to the video bus lines at the start of a write period of the horizontal scan period, and supplies the compensation data "A" to the video bus lines during a blanking period of a horizontal scan period that just precedes the horizontal scan period in question. As a result, the video bus lines are already charged by the compensation data "A" at the start of the write period of the horizontal scan period in question. Namely, the data lines of a first block to be scanned at the start of the write period may have correct voltages for the video data. Then, the first block presents a proper contrast to make a boundary unnoticeable, thereby clearly displaying images on the display.

The method may further include the steps of preparing, for each horizontal scan period, compensation data "B" whose voltages are substantially equal to those of video data to be supplied to the video bus lines at the end of a write period of the horizontal scan period in question, and supplying the compensation data "B" to the video bus lines during a blanking period of the horizontal scan period in question.

Namely, in addition to the compensation data "A," the method prepares, for each horizontal scan period, compensation data "B" whose voltages are substantially equal to those of video data to be supplied to the video bus lines at the end of a write period of the horizontal scan period in question, and supplies the compensation data "B" to the video bus lines during a blanking period of the horizontal scan period in question. The compensation data "B" prevents a ghost, to further improve the quality of display.

The method may further include the steps of preparing, for each horizontal scan period, black video data and supplying the black video data after the compensation data "B" to the video bus lines during a blanking period of the horizontal scan period in question.

Namely, in addition to the compensation data "A" and "B," the method prepares, for each horizontal scan period, black video data and supplies the black video data after the compensation data "B" to the video bus lines during a blanking period of the horizontal scan period in question. The black video data prevents horizontal crosstalk when a horizontal line displays halftones on consecutive pixels and black or white on a last pixel, thereby improving the quality of display.

As a preferable embodiment, the compensation data "A" prepared for a horizontal scan period may be equal to video data to be supplied to the video bus lines at the start of a write period of the horizontal scan period.

As a preferable embodiment, the compensation data "B" prepared for a horizontal scan period may be equal to video data to be supplied to the video bus lines at the end of a write period of the horizontal scan period.

As a preferable embodiment, the compensation data "A" prepared for a horizontal scan period may be supplied to the video bus lines just before video data for the start of a write period of the horizontal scan period is supplied to the video bus lines.

As a preferable embodiment, the compensation data "B" prepared for a horizontal scan period may be supplied to the video bus lines just after video data for the end of a write period of the horizontal scan period is supplied to the video bus lines.

As a preferable embodiment, the data lines may be disconnected from the video bus lines during the blanking period of each horizontal scan period.

As a preferable embodiment, the gate line driver and data line driver may be integrated on the first electrode substrate.

As a preferable embodiment, the data line driver may include the video bus lines.

As a preferable embodiment, the data lines may be divided into at least first and second groups, and the data line driver may sample video data simultaneously for the first and second groups starting from a data line proximate to a boundary between the first and second groups toward a data line at the opposite end in each of the first and second groups.

According to this embodiment, may eliminate discontinuity along a boundary between the adjacent areas.

BRIEF DESCRIPTION OF THE DRAWINGS

FIG. 8 shows video data rearranged according to the first embodiment;

DESCRIPTION OF THE PREFERRED EMBODIMENTS

Embodiments of the present invention will be explained with reference to the accompanying drawings. In this embodiments, the present invention is applied to AM-LCDs having polysilicon TFTs.

1.1 First Embodiment 1.1.1 Structure of LCD

Figure 1:
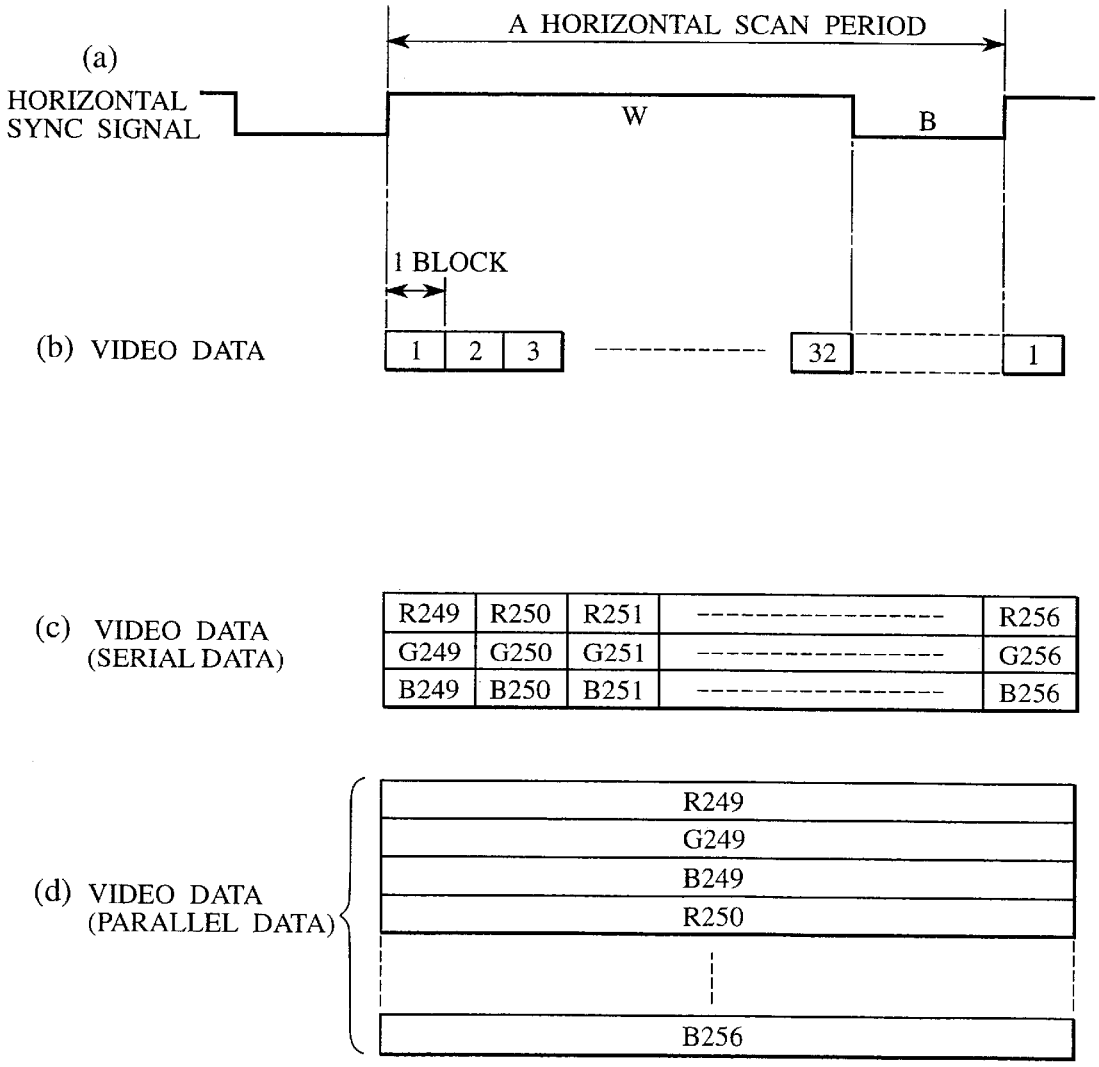
FIG. 1 is a timing chart showing a method of driving a flat-panel display device according to the prior art.
Figure 2:
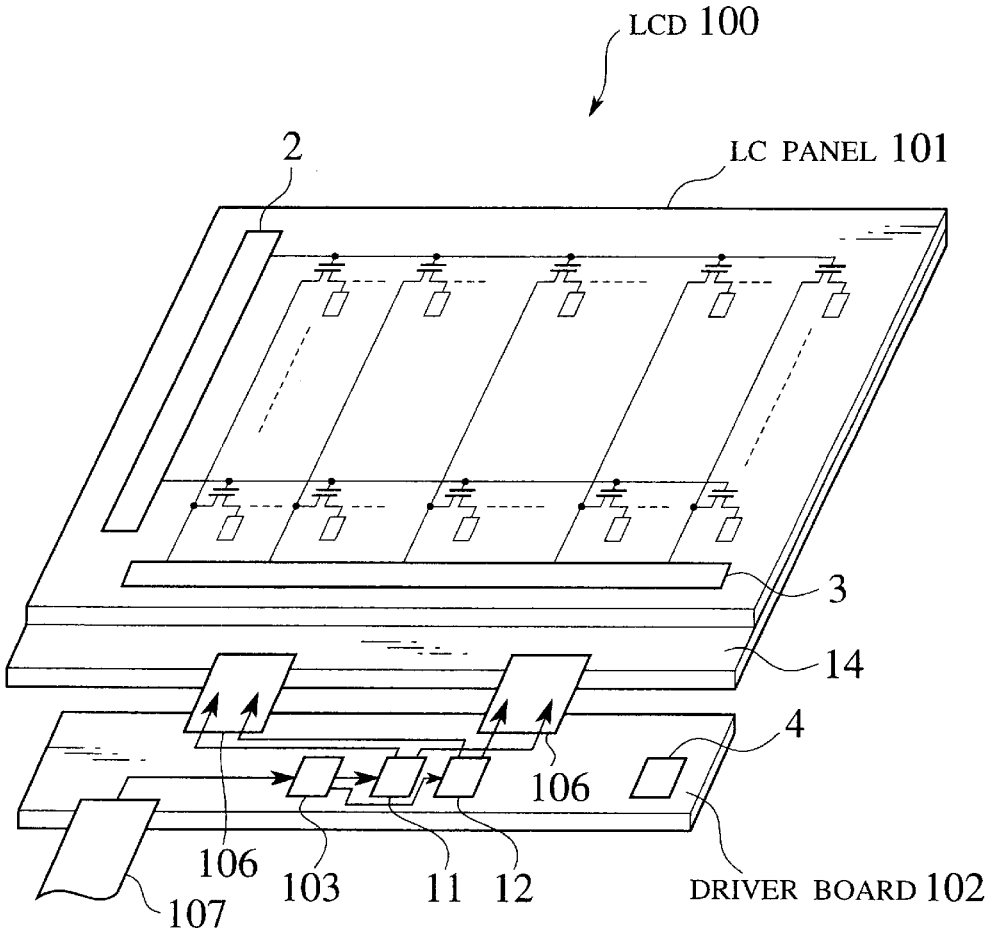
FIG. 2 generally shows an LCD that is driven according to a first embodiment of the present invention.

FIG. 2 generally shows an LCD having polysilicon TFTs driven according to the first embodiment of the present invention. The LCD 100 has an LC panel 101 with drivers, a driver board 102 for supplying analog video data, vertical and horizontal synchronous signals, and clock signals to the panel 101, and flexible printed circuits (FPCs) 106 for electrically connecting the panel 101 and driver board 102 to each other.

Figure 3:
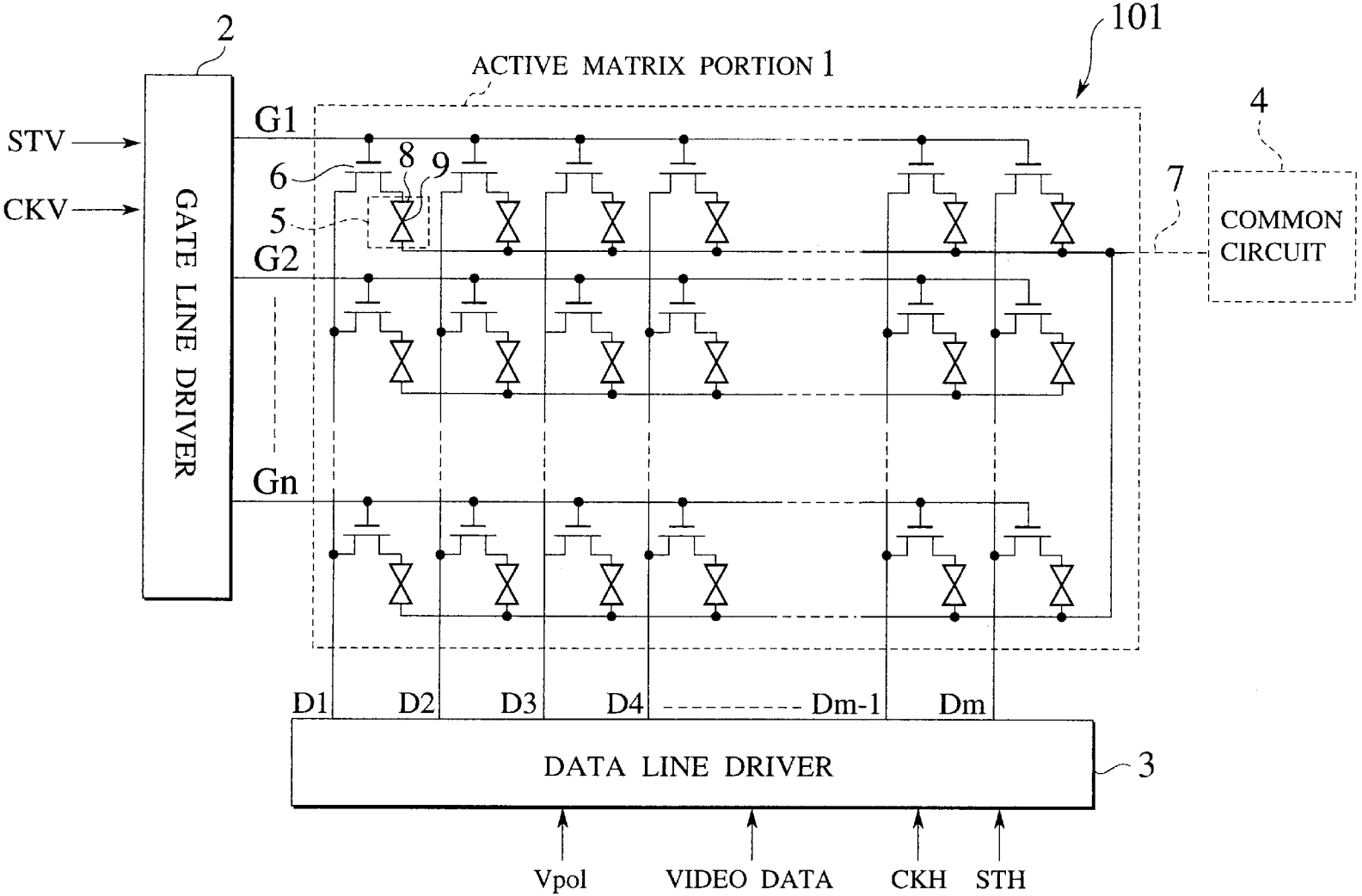
FIG. 3 is a circuit diagram showing an LC panel of the LCD of FIG. 2.

FIG. 3 is a circuit diagram showing the panel 101. The panel 101 has an active matrix portion 1, a gate line driver 2, and a data line driver 3. The drivers 2 and 3 drive the active matrix portion 1. A common circuit (counter electrode driver) 4 is arranged on the driver board 102 as shown in FIG. 2 and is also shown in FIG. 3 for the sake of easy understanding.

The active matrix portion 1 has liquid crystal pixels 5 arranged in a matrix. Each of the pixels 5 consists of a pixel electrode 8, a counter electrode 7, and a liquid crystal layer 9 sandwiched between the electrodes 8 and 7. The pixel electrode 8 is connected to a TFT 6 serving as a switch element to write video data into the pixel electrode 8. The gate of the TFT 6 is connected to a corresponding one of gate lines G1 to Gn that form rows of the active matrix portion 1. The drain of the TFT 6 is connected to a corresponding one of data lines D1 to Dm that form columns of the active matrix portion 1. The source of the TFT 6 is connected to the pixel electrode 8. The counter electrodes 7 of all pixels 5 are connected to the common circuit 4.

The gate line driver 2 has a shift register (not shown) and a buffer (not shown). In response to a vertical synchronous signal STV and vertical clock signal CKV provided by the driver board 102, the gate line driver 2 supplies an address signal sequentially to the gate lines G1 to Gn.

The data line driver 3 has analog switches (not shown) for connecting the data lines D1 to Dm to video bus lines, which is turned on and off by a control signal, a sample-hold circuit (not shown) for supplying a control signal to the analog switches, and a shift register (not shown) for controlling the operation timing of the sample-hold circuit. The data line driver 3 receives a horizontal synchronous signal STH, horizontal clock signal CKH, polarity inversion signal Vpol, and analog video data from the driver board 102. The data line driver 3 is divided into four parts as will be explained later.

The TFTs 6, pixels electrodes 8, gate line driver 2, and data line driver 3 are integrated on an insulating substrate 14. Also, shift registers and switches in the gate line driver 2 and data line driver 3 are made of polysilicon TFTs.

The driver board 102 of FIG. 2 has a control IC 103, a positive D/A converter 11, a negative D/A converter 12, and the common circuit 4. The driver board 102 is connected to a personal computer (PC) (not shown) through an FPC 107.

To reduce power consumption, the first embodiment employs the two D/A converters 11 and 12 each having small output amplitude, one for positive polarity and the other for negative polarity. Accordingly, the data line driver 3 supplies positive video data and negative video data to the data lines through separate paths, and the polarities of the video bus lines in the data line driver 3 are not alternated, thereby halving the amplitude of video data. The present invention, however, is not limited to this arrangement with two D/A converters. The present invention is also achievable with a single D/A converter.

Figure 4:
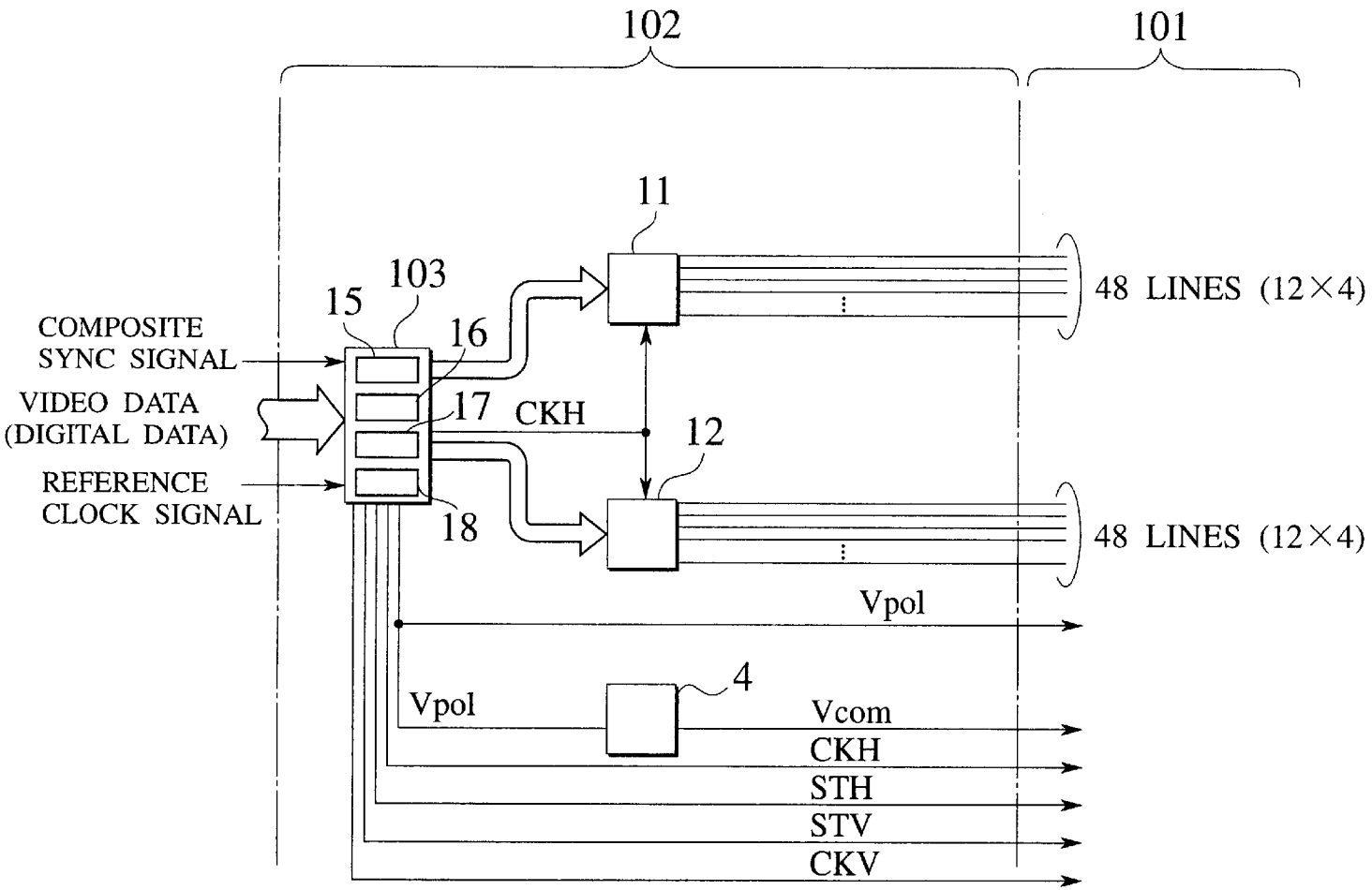
FIG. 4 is a circuit diagram showing an external driver of the LCD of FIG. 2.

FIG. 4 shows essential parts of the driver board 102. The control IC 103 receives digital video data, reference clock signal, and composite synchronous signal (including vertical and horizontal synchronous signals) from the PC. The panel 101 contains 1024 pixels in each horizontal line (row). Each pixel consists of red (R), green (G), and blue (B) sub-pixels. Namely, digital video data from the PC includes 3072 pieces (1024×3) of bit data for each horizontal line.

The control IC 103 has a rearrangement circuit 15, a selector 16, a control signal generator 17, a video data controller 18, and other controllers (not shown).

The rearrangement circuit 15 rearranges digital video data from the PC so that the data may properly be sampled for the video bus lines according to polarity inversion. The rearrangement circuit 15 includes a 2-line memory (not shown).

The selector 16 selectively provides the rearranged data to the D/A converters 11 and 12 according to the polarity of a frame.

The control signal generator 17 receives the reference clock signal and composite synchronous signal from the PC and generates the polarity inversion signal Vpol, clock signals, and other control signals.

The video data controller 18 adds compensation data to the rearranged data. More precisely, the video data controller 18 prepares compensation data that is equal to video data provided at the start of a horizontal scan period and inserts the compensation data just before the video data provided at the start of the horizontal scan period.

The positive and negative D/A converters 11 and 12 convert the digital video data provided by the control IC 103 into analog parallel video data, which is supplied to the video bus lines of the data line driver 3.

According to the first embodiment, a frame of image displayed on the panel 101 is divided into four areas along the data lines and each area into 32 blocks. Each block includes 24 data lines. Each of the four areas simultaneously receives 24 pieces of video data for one of the 32 blocks through the 24 data lines. In more detail, the positive D/A converter 11 provides 12 pieces of positive video data to each area, i.e., 48 pieces of positive video data in total for the four areas. The negative D/A converter 12 provides 12 pieces of negative video data to each area, i.e., 48 pieces of negative video data in total for the four areas.

The D/A converter 11 contains 48 positive D/A converter elements (not shown), and the D/A converter 12 contains 48 negative D/A converter elements (not shown).

1.1.2 Polarity Inversion

Polarity inversion to drive the panel 101 will be explained.

To maintain the quality of a liquid crystal layer, a standard LCD alternates the polarities of potential differences applied to pixel electrodes and counter electrodes frame by frame. To invert polarities, there are a V-line inversion method that alternates potential-difference polarities vertical line by vertical line (column by column), and an H-V-line inversion method that alternates potential-difference polarities pixel by pixel.

To drive liquid crystals, a voltage of about ±5 V is necessary. Accordingly, these inversion methods require drivers that have a withstand voltage of 10 V, and therefore, hardly reduce power consumption. To solve this problem, low-power-consumption LCDs have been proposed.

An example of such low-power-consumption LCDs is disclosed in Japanese Unexamined Patent Publication No. Hei-9-186161. The LCD of this disclosure has D/A converters for converting serial digital video data into parallel analog data, and amplifiers connected to the D/A converters, respectively. The amplifiers connected to adjacent D/A converters are connected to voltage sources of opposite polarities. Each amplifier has a pair of switches that are connected to data lines, respectively. According to this disclosure, drivers may have a withstand voltage of the same polarity, to reduce power consumption. Adjacent data lines may share a video data bus, to reduce the number of video data buses as well as circuit sizes.

According to this disclosure, odd D/A converters drive odd data lines and even D/A converters drive even data lines in a frame period. In the next frame period, the odd D/A converters drive the even data lines and the even D/A converters drive the odd data lines. To invert polarities, the disclosure employs an external memory to rearrange video data frame by frame.

An LC panel driving method mentioned below employs the same polarity inversion technique and video data rearranging technique as those of the above-mentioned disclosure.

1.1.3 Method of Driving LC Panel

A basic method of driving the LC panel 101 (FIG. 2) will be explained.

Figure 5:
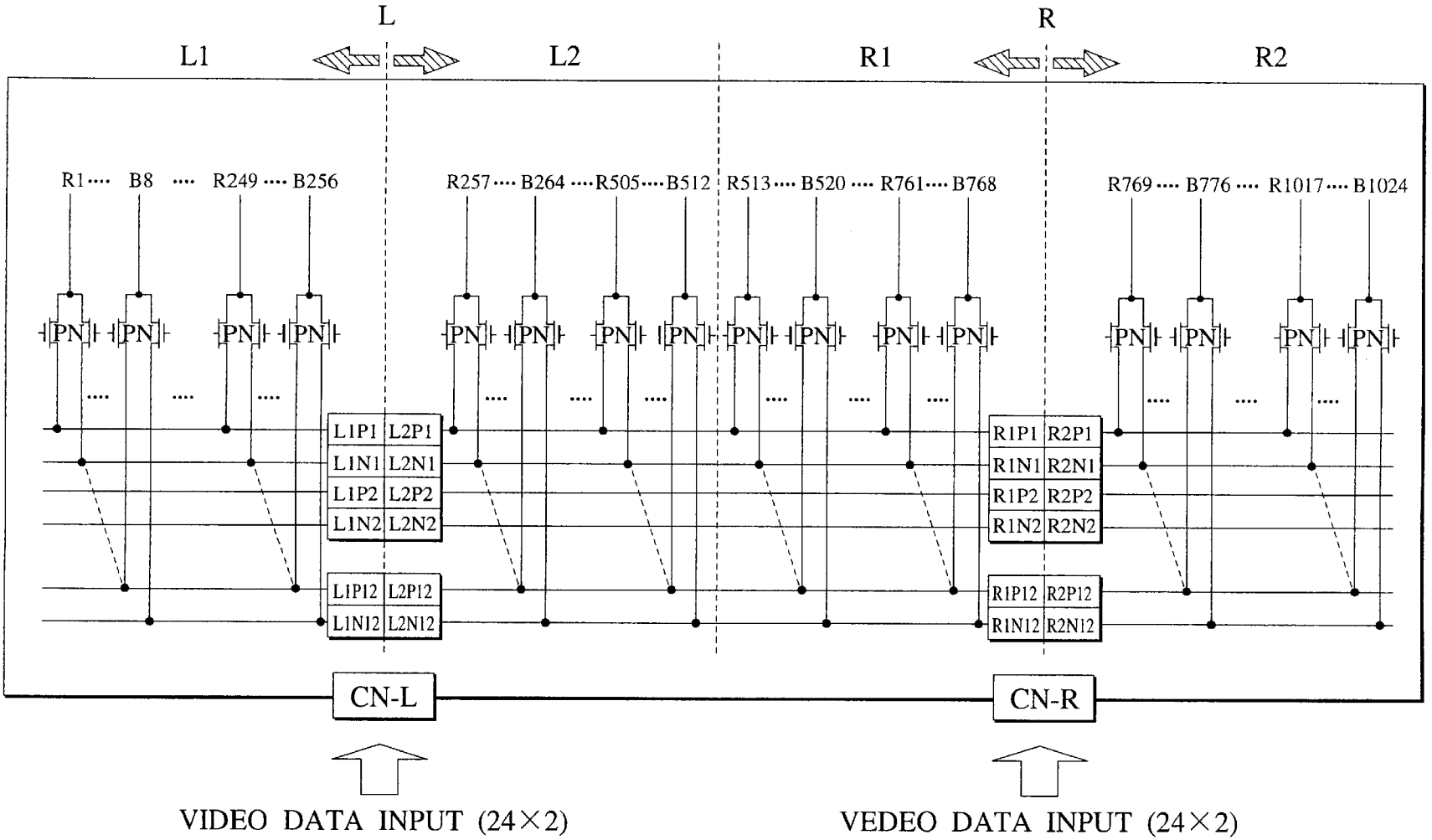
FIG. 5 is a wiring diagram explaining a method of driving the LCD of FIG. 2.

FIG. 5 is a wiring diagram showing the method of driving the panel 101 and the relationship between data lines and video bus lines connected thereto.

The panel 101 is divided into four areas L1, L2, R1, and R2 along the data lines. Boundaries of these areas are indicated with dotted lines. The data lines in the four areas are scanned from the boundaries L and R in arrow directions, to eliminate discontinuity along the boundaries of the four areas.

To achieve such scanning, the data line driver 3 is internally divided into four. Namely, the data line driver 3 has shift registers, sample-hold circuits, etc., for the four areas, respectively.

Compared with driving a frame with a shift register, simultaneously driving four areas of a frame with four shift registers can quadruple the sampling time of each shift register, to improve the quality of display.

Each of channels CN-L and CN-R receives 48 pieces of analog video data from the driver board 102. Namely, the channel CN-L receives 48 pieces of analog video data for the areas L1 and L2 each of which receives 24 pieces of the analog video data, and the channel CN-R receives 48 pieces of analog video data for the areas R1 and R2 each of which receives 24 pieces of the analog video data.

Each of the four areas L1, L2, R1, and R2 of the panel 101 has 24 video bus lines such as L1P1, L1N1, . . . , L1N12 to pass the video data to analog switches (not shown).

The video bus lines include ones to receive positive video data and ones to receive negative video data. The positive and negative video bus lines are alternately arranged. Any video bus line that receives positive video data has a suffix "P" and any video line that receives negative video data has a suffix "N" in FIG. 5. For example, the video bus line L1P1 receives positive video data, and the video bus line L1N1 receives negative video data.

Figure 6:
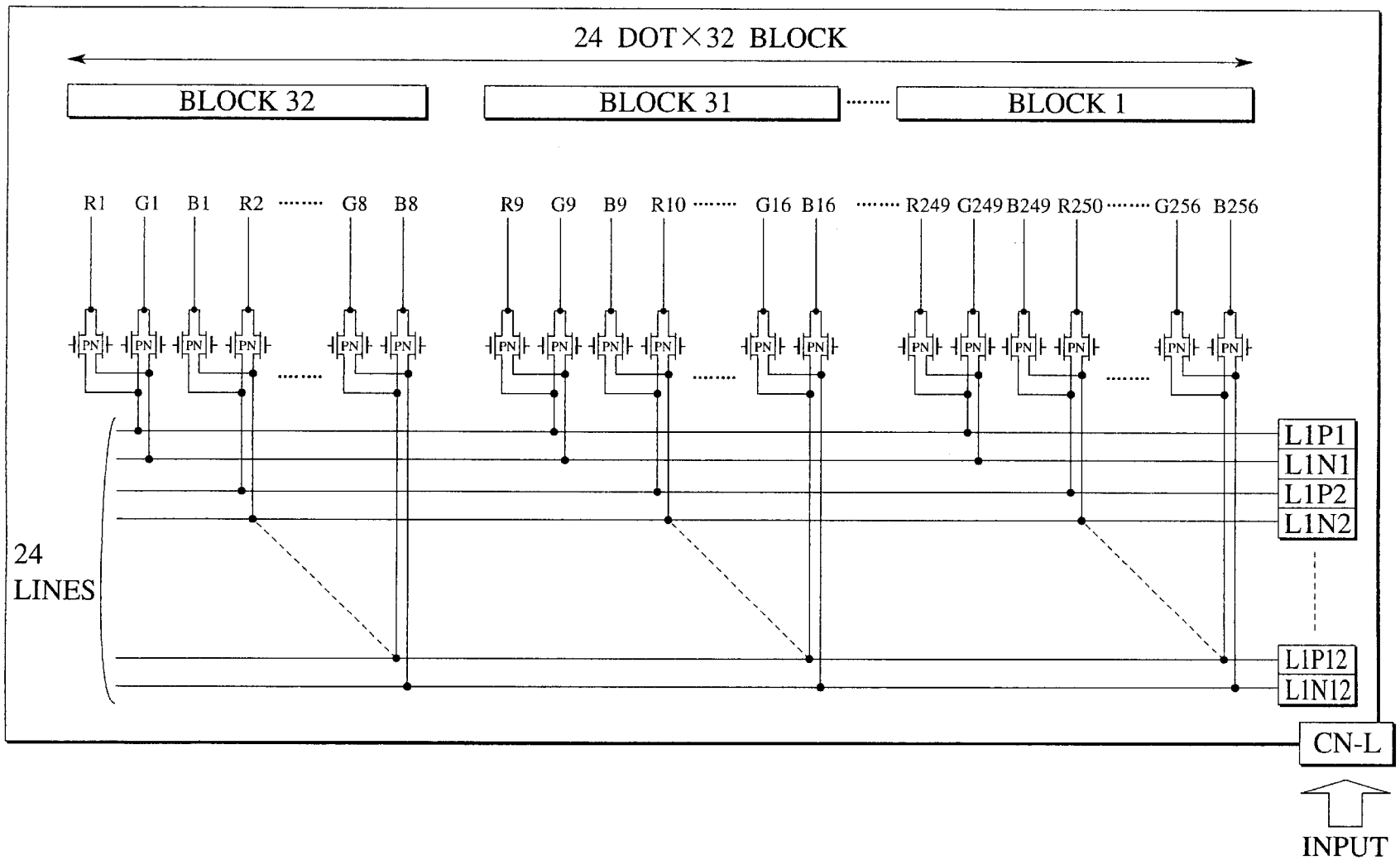
FIG. 6 is an enlarged view showing an area L1 of FIG. 5.

FIG. 6 is an enlarged view showing the area L1 of FIG. 5. Each area is divided into 32 blocks, and each block includes 8 data lines for each of red, green, and blue, i.e., 24 data lines in total in each block. For example, the block 1 has data lines to receive data pieces R249 to R256, G249 to G256, and B249 to B256. Similarly, the block 32 has data lines to receive data pieces R1 to R8, G1 to G8, and B1 to B8.

Each block simultaneously samples 24 data pieces through the 24 data lines including 8 data lines for red, 8 data lines for green, and 8 data lines for blue. The data pieces sampled by each block through the 24 data lines form 8 pixels in a horizontal line (row) on the panel 101. In each of the areas L1, L2, R1, and R2, the 32 blocks sequentially sample video data and write the video data in a horizontal line.

In the area L1 of FIG. 6, video data is sampled for the 32 blocks sequentially from the block 1 toward the block 32. Namely, in the area L1, the video data pieces R1 to B256 are sampled from the data piece B256 toward the data piece R1. In the other areas L2, R1, and R2, video data pieces are sampled in the same manner. Since each block includes 24 data lines, each area includes 768 data lines (24×32) because each area consists of 32 blocks. This means that a horizontal scan period covering the four areas involves 3072 data lines. Video data pieces sampled for these 3072 data lines form 1024 pixels along each horizontal line. Such video data sampling is repeated for all gate lines, which correspond to horizontal lines, respectively, to write a frame of the panel 101.

The first embodiment drives the panel 101 according to the V-line inversion method. In each frame period, the data line driver 3 samples video data of opposite polarities so that the potentials of adjacent data lines may have opposite polarities with respect to a reference voltage. In addition, the polarities of the data lines are inverted frame by frame.

Figure 7:
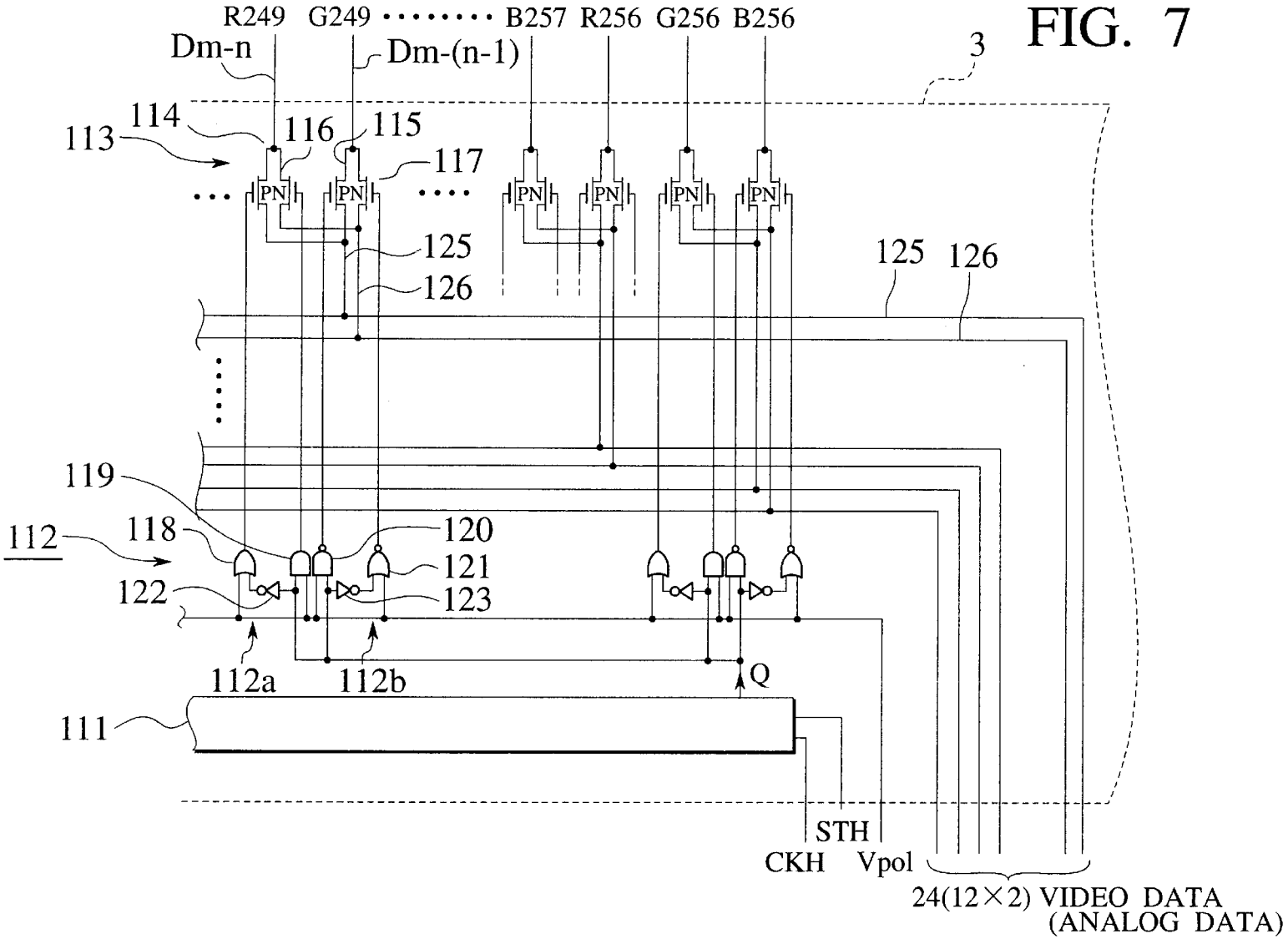
FIG. 7 is a circuit diagram showing a part of a data line driver of the LCD of FIG. 2.

FIG. 7 shows a part of the data line driver 3 for driving the area L1 of FIG. 6. The part shown in FIG. 7 is one of the four sections of the data line driver 3 that drive the areas L1, L2, R1, and R2, respectively. In FIG. 7, elements having reference numerals are representative elements among like parts.

The part shown in FIG. 7 of the data line driver 3 consists of a shift register 111, a sample-hold circuit 112, and an analog switch circuit 113. The shift register 111 provides a control signal Q according to which the sample-hold circuit 112 controls the conductivity of the analog switch circuit 113. The data line driver 3 samples analog video data provided by the driver board 102 for the data lines in synchronization with the horizontal clock signal CKH.

The control signal Q is supplied to odd switches 112*a* and even switches 112*b*. A video bus line 125 receives a positive analog signal, and a video bus line 126 receives a negative analog signal.

The analog switch circuit 113 contains a pair of p-channel transistor 114 and n-channel transistor 116, and a pair of p-channel transistor 115 and n-channel transistor 117. The positive video bus line 125 is connected to data lines Dm-n and Dm-(n−1) through the transistors 114 and 115. The negative video bus line 126 is connected to the data lines Dm-n and Dm-(n−1) through the transistors 116 and 117.

The gate of the transistor 114 is connected to an output terminal of an OR gate 118. The gate of the transistor 116 is connected to an output terminal of an AND gate 119. The ate of the transistor 115 is connected to an output terminal of a NAND gate 120. The gate of the transistor 117 is connected to an output terminal of a NOR gate 121.

The gate elements 118 to 121 receive the polarity inversion signal Vpol. The gate elements 119 and 120 receive the control signal Q from the shift register 111. The OR gate 118 receives the control signal Q through an inverter 122. The NOR gate 121 receives the control signal Q through an inverter 123. The shift register 111 sequentially shifts the horizontal synchronous signal STH in synchronization with the horizontal clock signal CKH. The shift register 111 provides the control signal Q according to the horizontal synchronous signal STH.

The operation of the adjacent data lines Dm-n and Dm-(n−1) and the related analog switch 113 and switches 112*a* and 112*b* will be explained. The polarity inversion signal Vpol supplied to the switches 112*a* and 112*b* is low to indicate a positive polarity and high to indicate a negative polarity. The signal Vpol is changed frame by frame.

An operation in a write period in a horizontal scan period will be explained. If the polarity inversion signal Vpol is low, the OR gate 118 passes the control signal Q, and the output of the AND gate 119 is low. The output of the NAND gate 120 is high, and the NOR gate 121 provides an inversion of the control signal Q. As a result, the transistor 114 becomes conductive in response to the control signal Q, and the transistors 116 and 115 become nonconductive. The transistor 117 becomes conductive in response to the control signal Q. Consequently, the data line Dm-n samples positive video data according to the control signal Q, and the data line Dm-(n−1) samples negative video data according to the control signal Q.

If the polarity inversion signal Vpol is high, the OR gate 118 becomes high, and the AND gate 119 passes the control signal Q. The NAND gate 120 provides an inversion of the control signal Q, and the output of the NOR gate 121 becomes low. As a result, the transistor 114 becomes nonconductive, and the transistor 116 becomes conductive in response to the control signal Q. The transistor 115 becomes conductive in response to the control signal Q, and the transistor 117 becomes nonconductive. Consequently, the data line Dm-n samples negative data according to the control signal Q, and the data line Dm-(n−1) samples positive video data according to the control signal Q.

During a blanking period in each horizontal scan period, the shift register 111 provides no control signal Q, and therefore, the transistors in the analog switch circuit 113 are each nonconductive. During the blanking period, compensation data is supplied to the video bus lines 125 and 126 to charge the video bus lines 125 and 126.

The above operation is repeated frame by frame, so that the data lines Dm-n and Dm-(n−1) alternately sample positive and negative video data. Similarly, the other data lines alternately sample positive and negative video data.

In FIG. 7, the video bus line 125 receives only positive vide o data, and the video bus line 126 receives only negative video data. Namely each gate element in the sample-hold circuit 112 is operated with a withstand voltage of single polarity, thereby reducing power consumption.

1.1.4 Data rearrangement and Distribution

FIG. 8 shows video data rearranged by the control IC 103. The right side of FIG. 8 shows video data pieces supplied from the PC and rearranged by the control IC 103 to display them in a horizontal line on the panel 101. The rearranged video data pieces are distributed to the 32 blocks of each of the areas L1, L2, R1, and R2 of the panel 101. The left side of FIG. 8 shows the polarity (POL) of the polarity inversion signal Vpol and rules for distributing the video data pieces for the video bus lines according to the signal Vpol. If POL=0 (low), the polarity inversion signal Vpol is positive, and if POL=1 (high), the signal Vpol is negative .

Data distribution for the block 1 in the area L1 will be explained .

If POL=0, the block 1 receives a video data piece R249 through the video bus line L1P1 and a video data piece G249 through the video bus line L1N1. The data piece R249 is sampled through the p-channel transistor 114 (FIG. 7) for the data line Dm-n. The data piece G249 is sampled through the n-channel transistor 117 for the data line Dm-(n−1). If POL=1, the block 1 receives a video data piece G249 through the video bus line L1P1 and a video data piece R249 through the video bus line L1N1. The data piece G249 is sampled through the p-channel transistor 115 for the data line Dm-(n−1), and the data piece R249 is sampled through the n-channel transistor 116 for the data line Dm-n. The rearrangement data pieces of FIG. 8 make the video bus line 125 always receive positive video data pieces and the video bus line 126 negative video data pieces. Although the adjacent data lines Dm-n and Dm-(n−1) alternately receive positive and negative video data pieces, each of the video bus lines 125 and 126 always receives video data of the same polarity.

1.1.5 Video Data to Video Bus Lines According to First Embodiment

Video data supplied to the video bus lines of the panel 101 according to the first embodiment will be explained.

Figure 9:
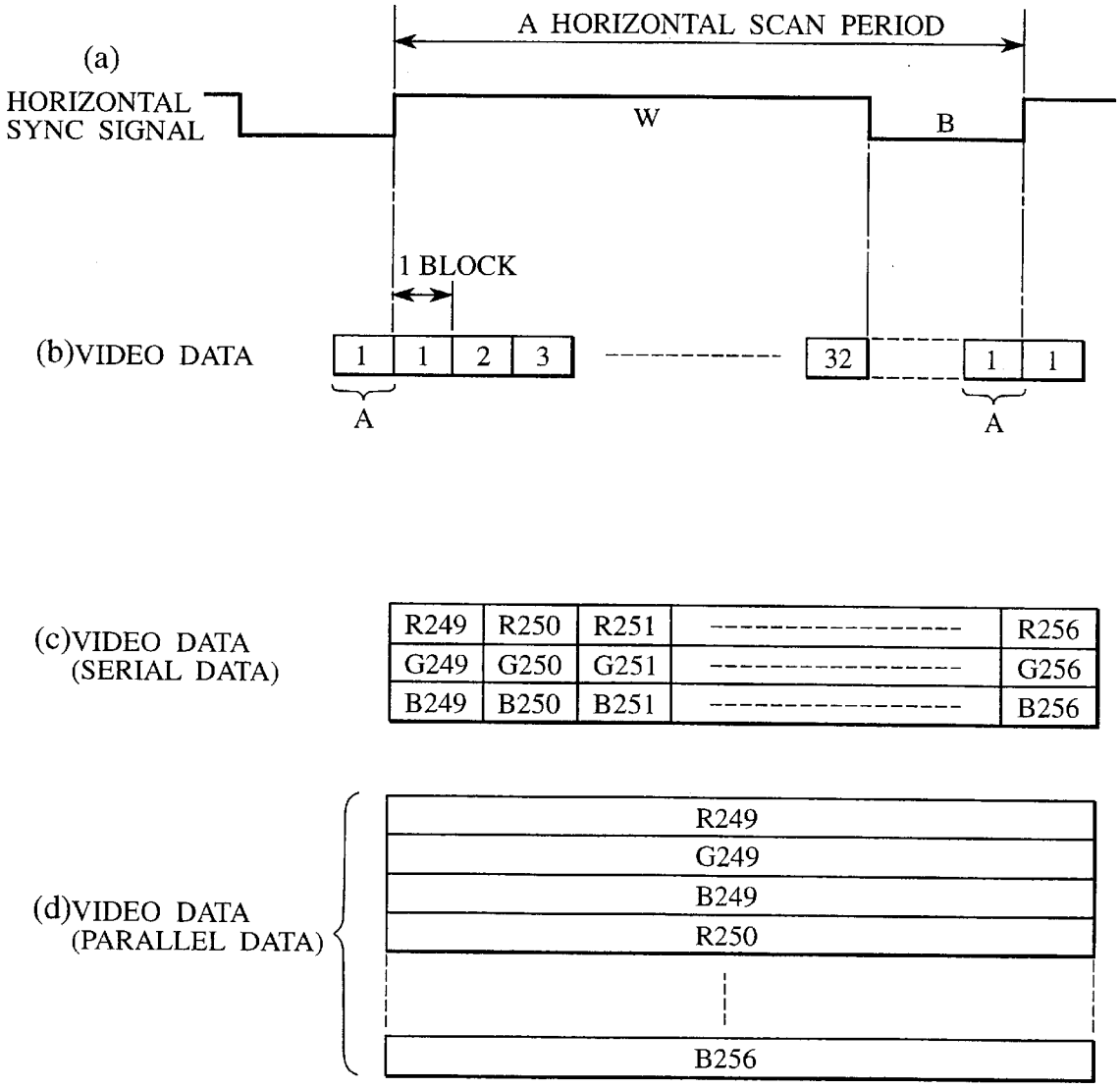
FIG. 9 is a timing chart explaining the first embodiment.

FIG. 9 is a timing chart showing the LCD driving method of the first embodiment.

The driving method of FIG. 9 drives the panel 101 of FIG. 2. The first embodiment divides the panel 101 into four areas and each area into 32 blocks.

The data line driver 3 receives analog video data from the driver board 102 in synchronization with a rise of a horizontal synchronous signal (a). The analog video data includes rearranged video data and compensation data A. The compensation data A is equal to video data for the block 1 that is at the start of a horizontal scan period. The compensation data A is supplied in a blanking period that just precedes the video data for the block 1. In the remaining part of the blanking period, signals irrelevant to display are supplied.

The compensation data A charges the video bus lines before the start of a write period of the horizontal scan period in question. This secures correct voltages for the video data for the data lines of the block 1, and therefore, the block 1 always provides a correct contrast.

As a result, a boundary at the start of the write period becomes unnoticeable so that the panel 101 may display high-quality images.

1.2 Second Embodiment

A method of driving an LCD according to the second embodiment of the present invention will be explained. The second embodiment is applied to, as an example, the LCD having polysilicon TFTs of FIG. 2.

1.2.1 Structure of LCD

According to the second embodiment, the video data controller 18 (FIG. 4) adds two pieces of compensation data and a piece of black video data to rearranged video data provided by the rearrangement circuit 15. More precisely, the second embodiment prepares compensation data A that is equal to video data for the start of a horizontal scan period and inserts the compensation data A just before the video data for the start of the horizontal scan period. The second embodiment also prepares compensation data B that is equal to video data for the end of a horizontal scan period and inserts the compensation data B just after the video data for the end of the horizontal scan period. Further, the second embodiment prepares black video data and inserts the black video data after the compensation data B.

1.2.2 Video Data to Video Bus Lines According to Second Embodiment

Video data supplied to the video bus lines of the panel 101 according to the second embodiment will be explained.

Figure 10:
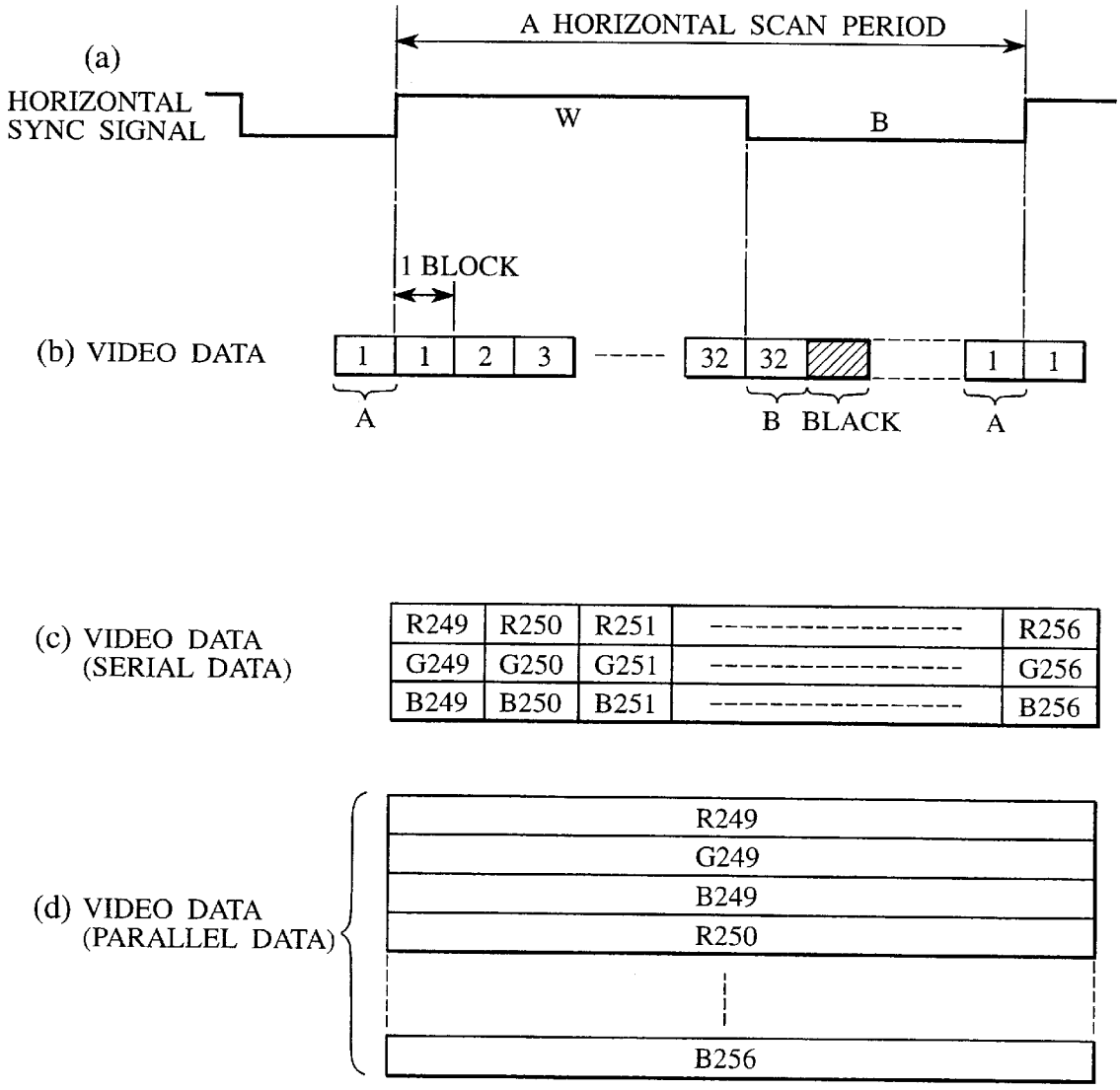
FIG. 10 is a timing chart explaining an LCD driving method according to a second embodiment of the present invention.

FIG. 10 is a timing chart explaining the operation of the second embodiment. Like the first embodiment, the second embodiment divides the panel 101 into four areas and each area into 32 blocks.

The data line driver 3 receives analog video data from the driver board 102 in synchronization with a rise of a horizontal synchronous signal (a). The analog video data includes rearranged video data, compensation data A, compensation data B, and black video data.

The compensation data A is equal to video data for the block 1 that is at the start of a horizontal scan period. The compensation data B is equal to video data for the block 32 that is at the end of the horizontal scan period. The black video data added to the compensation data B lasts for one block period. The remaining part of each blanking period receives data irrelevant to display.

The compensation data A inserted just before video data provided for the start of a horizontal scan period helps increase the voltages of the video data provided for the start of the horizontal scan period to correct levels. As a result, the block 1 secures a required contrast. The compensation data B added to video data provided for the end of the horizontal scan period prevents a ghost due to a voltage delay in the block 32 that is at the end of a write period of the horizontal scan period. The black video data added to the compensation data B suppresses horizontal crosstalk. Even if a horizontal line involves consecutive pixels that display halftones and a last pixel that displays black or white, the black video data added to the compensation data B prevents color disturbance in the horizontal line. Namely, it prevents the horizontal line from partly becoming white or black.

The second embodiment makes a boundary along the first block of each area of the panel 101 unnoticeable, thereby properly displaying images on the panel 101. The second embodiment suppresses a ghost at a last block that is at the end of a write period in each area. Even if a horizontal line displays halftones on consecutive pixels and black or white on a last pixel, the second embodiment causes no horizontal Various modifications will become possible for those skilled in the art after receiving the teachings of the present disclosure without departing from the scope thereof.

For example, the compensation data A that is equal to video data for the first block of a horizontal line according to the first embodiment may not be equal to the video data for the first block if the voltages of the compensation data A are substantially equal to those of the video data for the first block.

It is not always necessary to insert the compensation data A just before the first block. It may be inserted anywhere in a blanking period of the preceding horizontal scan period.

The period of the compensation data in a blanking period may be shorter or longer than the period of one block. To sufficiently charge the video bus lines with the compensation data, it is preferable that the period of the compensation data is longer than the period of one block.

To eliminate horizontal crosstalk, the second embodiment inserts black video data of at least one-block period in a blanking period. The period of the black video data may be equal to two or more blocks.

The second embodiment makes the compensation data A equal to video data for the first block that is at the start of a horizontal line in each area. The compensation data A of the second embodiment is not necessarily equal to the video data for the first block if the voltages of the compensation data A are substantially equal to those of the video data for the first block.

It is possible to insert the compensation data A that is equal to first video data provided at the start of a horizontal scan period just before the first video data and inserts the compensation data B that is equal to last video data provided at the end of the horizontal scan period just after the last video data. This technique also makes a boundary of each area unnoticeable and suppresses a ghost at the last block in a write period.

Although the first and second embodiments employ the V-line inversion method, the present invention is also applicable to the H-V-line inversion method that inverts the polarities of video data row by row.

The embodiments mentioned above are only for exemplary purposes and are not intended to limit the present invention. The scope of the present invention is specified in the following claims and it is understood that all modifications that fall under the claims are covered by the present invention.

What is claimed is:

1. For driving a flat-panel display device having:

a first electrode substrate including data lines, gate lines to form a matrix, pixel electrodes formed at intersections of the data and gate lines, respectively, and switch elements provided for the pixel electrodes, respectively, each of the switch elements being turned on and off by a gate signal passed through a corresponding one of the gate lines and connecting, if turned on, a corresponding one of the data lines to the corresponding pixel electrode to write sampled video data on the data line into the pixel electrode;

a second electrode substrate including counter electrodes that face the pixel electrodes with a predetermined gap between them;

an optical modulation layer sandwiched between the first and second electrode substrates;

a data line driver for connecting "n" of the data lines to video bus lines and sampling video data for the n data lines in synchronization with a horizontal scan period;

a gate line driver for supplying a gate signal to one of the gate lines in synchronization with a horizontal scan period; and an external driver for converting external video data into video data for "n" of the data lines and collectively supplying the video data to the video bus lines, a method comprising the steps of:

preparing, for each horizontal scan period, a single compensation data (A) whose voltages are substantially equal to those of video data to be supplied to the video bus lines at the start of a write period of the horizontal scan period; and supplying the single compensation data (A) to the video bus lines during a blanking period of a horizontal scan period that just precedes the horizontal scan period.

2. The method of claim 1, further comprising the steps of:

preparing, for each horizontal scan period, compensation data (B) whose voltages are substantially equal to those of video data to be supplied to the video bus lines at the end of a write period of the horizontal scan period; and supplying the compensation data (B) to the video bus lines during a blanking period of the horizontal scan period.

3. The method of claim 2, further comprising the steps of:

preparing, for each horizontal scan period, black video data; and supplying the black video data after the compensation data (B) to the video bus lines during a blanking period of the horizontal scan period.

4. The method of any one of claims 1 to 3, wherein:

the compensation data (A) prepared for a horizontal scan period is equal to video data to be supplied to the video bus lines at the start of a write period of the horizontal scan period.

5. The method of any one of claims 2 or 3, wherein:

the compensation data (B) prepared for a horizontal scan period is equal to video data to be supplied to the video bus lines at the end of a write period of the horizontal scan period.

6. The method of any one of claims 1–3, wherein:

the compensation data (A) prepared for a horizontal scan period is supplied to the video bus lines just before video data to be supplied to the video bus lines at the start of a write period of the horizontal scan period.

7. The method of any one of claims 2 or 3, wherein:

the compensation data (B) prepared for a horizontal scan period is supplied to the video bus lines just after video data to be supplied to the video bus lines at the end of a write period of the horizontal scan period.

8. The method of any one of claims 1–3, wherein:

the data lines are disconnected from the video bus lines during the blanking period of each horizontal scan period.

9. The method of claim 1, wherein:

the gate line driver and data line driver are integrated on the first electrode substrate.

10. The method of claim 9, wherein:

the data line driver includes the video bus lines.

11. The method of any one of claims 9 or 10, wherein:

the first electrode substrate is divided into at least two areas along the data lines; and the data line driver samples video data simultaneously for data lines on each area, so that the sampled video data is delivered to the data lines from a data line proximate to a boundary of each area toward a data line at the opposite end of the area.

* * * * *